US011485143B2

(12) United States Patent
Kuroyanagi

(10) Patent No.: US 11,485,143 B2
(45) Date of Patent: Nov. 1, 2022

(54) LIQUID DISCHARGING APPARATUS

(71) Applicant: BROTHER KOGYO KABUSHIKI KAISHA, Nagoya (JP)

(72) Inventor: Sosuke Kuroyanagi, Nishio (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/183,830

(22) Filed: Feb. 24, 2021

(65) Prior Publication Data

US 2021/0276335 A1 Sep. 9, 2021

(30) Foreign Application Priority Data

Mar. 3, 2020 (JP) ..... JP2020-035895

(51) Int. Cl.
*B41J 2/165* (2006.01)
*B41J 2/17* (2006.01)

(52) U.S. Cl.
CPC ..... *B41J 2/16579* (2013.01); *B41J 2/16505* (2013.01); *B41J 2/1721* (2013.01); *B41J 2002/16502* (2013.01)

(58) Field of Classification Search
CPC .. B41J 2/16579; B41J 2/16505; B41J 2/1721; B41J 2002/16502
See application file for complete search history.

(56) References Cited

FOREIGN PATENT DOCUMENTS

JP 3801003 B2 * 7/2006 ..... B41J 2/17509
JP 2008238530 A 10/2008
JP 2015142996 A 8/2015

* cited by examiner

*Primary Examiner* — Justin Seo
(74) *Attorney, Agent, or Firm* — Merchant & Gould P.C.

(57) ABSTRACT

A liquid discharging apparatus includes: a first storage which stores liquid; a first detector which detects an amount of the liquid in the first storage; a communication hole communicating the first storage and outside; a semipermeable membrane arranged to cover the communication hole; a head unit having at least one nozzle which discharges the liquid supplied from the first storage; a liquid flow channel which communicates the first storage and the head unit; a cap which seals the nozzle of the head unit; a cap movement mechanism which moves the cap; an electrode arranged in the cap and on which the liquid discharged from the nozzle is landed; a second detector connected electrically to the electrode; a suction mechanism which sucks the liquid and gas inside the cap; a waste liquid storage which stores the liquid sucked from inside of the cap by the suction mechanism; and a controller.

20 Claims, 12 Drawing Sheets

LIQUID DISCHARGING APPARATUS

CROSS REFERENCE TO RELATED APPLICATION

The present application claims priority from Japanese Patent Application No. 2020-035895, filed on Mar. 3, 2020, the disclosure of which is incorporated herein by reference in its entirety.

BACKGROUND

Field of the Invention

The present invention relates to a liquid discharging apparatus.

Description of the Related Art

In a conventional liquid discharging apparatus (for example, disclosed in Japanese Patent Application Laid-open No. 2008-238530), liquid contained in a main tank is supplied to a discharging head provided on a carriage. Then, printing is carried out on recording medium by discharging the supplied liquid from nozzles of the discharging head. In this liquid discharging apparatus, a sub tank is provided between the main tank and the discharging head to supply the liquid from the main tank to the discharging head via the sub tank.

SUMMARY

In the liquid discharging apparatus disclosed in Japanese Patent Application Laid-open No. 2008-238530, ink (the liquid) stored in the main tank is supplied to the discharging head from the sub tank, after the ink is once supplied to the sub tank. Further, the sub tank is provided with a communication hole and a gas permeable film (a semipermeable membrane) for the communication hole. Inside of the sub tank communicates with outside through the communication hole.

In such a liquid discharging apparatus, the ink in the sub tank may adhere to the semipermeable membrane if the liquid discharging apparatus is shaken or is not placed horizontally. The ink adhered to the semipermeable membrane may form a thin film due to drying and caking to block the semipermeable membrane as a result. If the ink caked in this manner causes clogging in the semipermeable membrane, then the atmospheric pressure can no longer be maintained in the sub tank, and the ink may not be discharged from the head.

The present invention is made to address the above problem, and an object thereof is to provide a liquid discharging apparatus capable of preventing the head from failing to discharge the liquid.

According to a first aspect of the present teaching, there is provided a liquid discharging apparatus including:

a first storage configured to store liquid;

a first detector configured to detect an amount of the liquid in the first storage;

a communication hole communicating the first storage and outside;

a semipermeable membrane arranged to cover the communication hole, the semipermeable membrane being configured to prevent the liquid from passing therethrough and to allow gas to pass therethrough;

a head unit having at least one nozzle configured to discharge the liquid supplied from the first storage;

a liquid flow channel configured to communicate the first storage and the head unit;

a cap having a lip and being configured to seal the nozzle of the head unit;

a cap movement mechanism configured to move the cap such that the lip of the cap contacts with and is separated from the head unit;

an electrode arranged in the cap and on which the liquid discharged from the nozzle is landed;

a second detector connected electrically to the electrode and configured to detect that the liquid is discharged from the nozzle toward the electrode;

a suction mechanism configured to suck the liquid and gas inside the cap;

a waste liquid storage configured to store the liquid sucked from inside of the cap by the suction mechanism; and a controller, wherein the controller is configured to:

under a condition that the first detector detects that there is no change in the amount of the liquid in the first storage, determine whether the semipermeable membrane is in a blocked state in which the gas is prevented from passing therethrough due to the liquid adhered to the semipermeable membrane;

under a condition that the semipermeable membrane is in the blocked state, drive the cap movement mechanism to position the cap to a predetermined posture in which the lip contacts with the head unit, and to drive the suction mechanism to discharge the gas and liquid inside the cap with the cap being positioned in the predetermined posture; and under a condition that the second detector detects an electrical change in the electrode caused by the liquid discharged from the nozzle toward the electrode in a state of the suction mechanism being driven, determine that the semipermeable membrane is in a state of allowing the gas to pass therethrough, and to stop driving the suction mechanism.

According to a second aspect of the present teaching, there is provided a liquid discharging apparatus including:

a first storage having a supply port through which liquid is supplied from outside thereof and configured to store the liquid;

an opening and closing member configured to open and close the supply port;

a first detector configured to detect an amount of the liquid in the first storage;

a communication hole communicating the first storage and the outside;

a semipermeable membrane arranged to cover the communication hole, the semipermeable membrane being configured to prevent the liquid from passing therethrough and to allow gas to pass therethrough;

a head unit having at least one nozzle configured to discharge the liquid supplied from the first storage;

a liquid flow channel configured to communicate the first storage and the head unit;

a cap configured to contact with the head unit to seal the nozzle, and configured to be separated from the head unit;

a second detector configured to detect that the liquid is discharged from the nozzle;

a suction mechanism configured to suck the liquid and gas inside the cap; and a controller, wherein the controller is configured to determine whether the amount of the liquid in the first storage changes over a predetermined amount, based on a change of detection signal from the first detector, and in a case of determining that the amount of the liquid in the first storage does not change over the predetermined range, the controller is configured to:

drive the suction mechanism with the cap being in contact with the head unit; and under a condition that the second detector detects that the liquid is discharged from the nozzle in a state of the suction mechanism being driven, stop driving the suction mechanism.

According to the above aspect of the present teaching, it is possible to prevent the head from failing to discharge the liquid.

DESCRIPTION OF THE EMBODIMENTS

<Configuration of a Liquid Discharging Apparatus>

Figure 1:
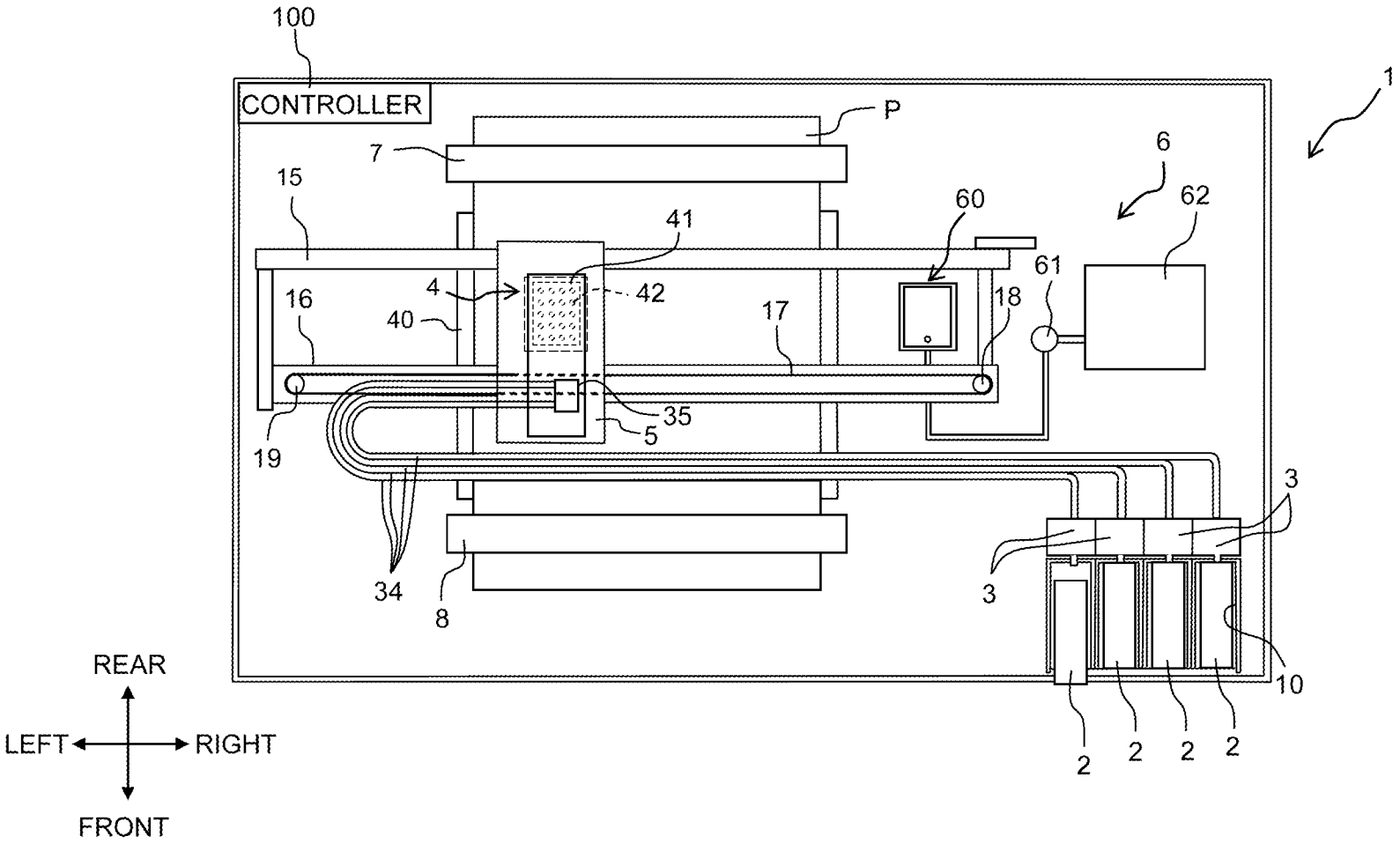
FIG. 1 depicts a schematic configuration of a liquid discharging apparatus according to a first embodiment of the present teaching.

A liquid discharging apparatus 1 is used, for example, as a color printer of an ink jet type. As depicted in FIG. 1, the liquid discharging apparatus 1 includes four cartridges 2 (corresponding to the second storage), four sub tanks 3 (corresponding to the first storage), a remaining amount detector 9 (corresponding to the first detector; see FIG. 2), a head unit 4, a platen 40, a carriage 5, a suction mechanism 6, a paper feed roller 7, a paper discharge roller 8, a display 130 (see FIG. 4), an operation unit 140 (see FIG. 4), and a controller 100.

Note that for the sake of convenience in explanation, the near side of the page of FIG. 1 is defined as "up or upper side", while the far side of the page is defined as "down or lower side" of the liquid discharging apparatus 1. Further, the front/rear direction and the left/right direction depicted with the arrows in FIG. 1 are defined as "front/rear direction" and "left/right direction" of the liquid discharging apparatus 1, respectively.

The four cartridges 2 are installed in a tank installation unit 10 in a removable manner, respectively. The four cartridges 2 respectively retain inks L (corresponding to the liquid) of the four colors: black, yellow, cyan, and magenta. These inks L are pigment inks where the pigment particles are dispersed in a solvent.

Figure 4:
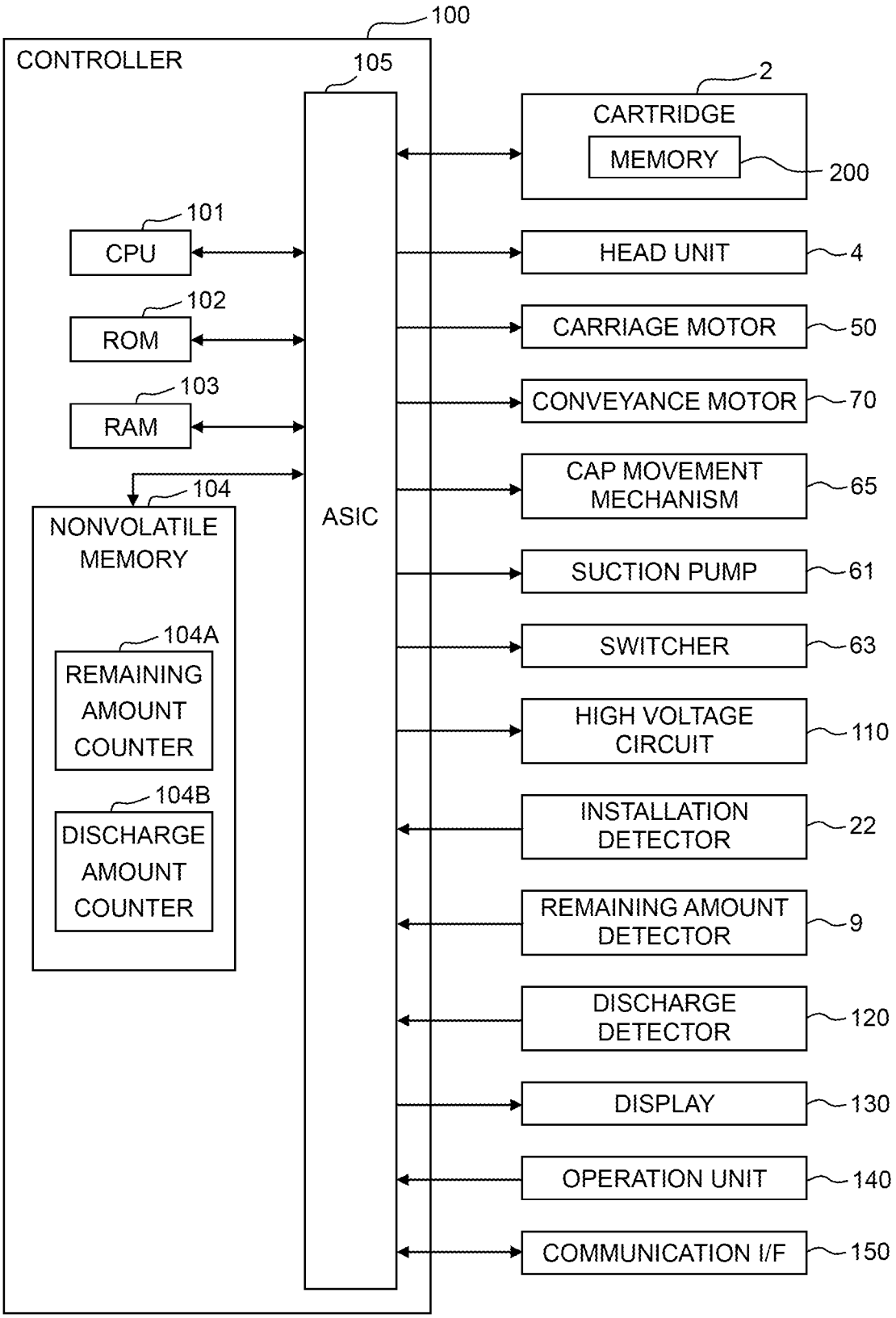
FIG. 4 is a block diagram depicting an electrical configuration of the liquid discharging apparatus according to the first embodiment.

Each of the cartridges 2 is provided with a memory 200 (see FIG. 4). The memories 200 store containment information and the like beforehand to depict the initial quantities of retaining the inks L of the respective colors retained at the time on their own shipment. Each of the memories 200 is connected electrically to the controller 100 on the installation of the cartridge 2.

As depicted in FIG. 1, the four sub tanks 3 are arranged to align in the left/right direction at the front side of the carriage 5. The four sub tanks 3 retain the inks L of the four colors corresponding to the four cartridges 2. Each of the sub tanks 3 is a tank capable of separating gas and liquid. When a cartridge 2 is installed into the tank installation unit 10, that cartridge comes into communication with the corresponding sub tank, such that the ink L is supplied from the cartridge 2 to the corresponding sub tank 3. The tank installation unit 10 is provided with an installation detector 22 (corresponding to the third detector) for detecting whether or not the cartridges 2 are connected respectively to the corresponding sub tanks 3.

The four sub tanks 3 are connected to the head unit 4 via four supply tubes 34 (corresponding to the liquid flow channel). The four supply tubes 34 are made of a flexible material in communication with the inside of the four sub tanks 3 and the inside of buffer tanks 41 of the head unit 4. The supply tubes 34 corresponding to the three colors of yellow, cyan and magenta are provided with unshown valves, respectively. These valves are controlled by the controller 100 for opening and closing.

Note that detailed configurations for the cartridges 2 and the sub tanks 3 will be described later on. The number of cartridges 2 and the number of sub tanks 3 are not limited to four but may be six, eight or the like for example. Further, in the case of a monochrome printer, providing one cartridge 2 and one sub tank 3 may suffice to correspond to the black color.

The head unit 4 has the buffer tanks 41 and a plurality of nozzles 42. The head unit 4 is mounted on the carriage 5. The buffer tanks 41 retain the inks L supplied from the sub tanks 3. Further, the buffer tanks 41 are provided integrally with tube joints 35, respectively. The ends of the four supply tubes 34 on one side are connected to the tube joints 35 in a removable manner, respectively. The ends of the four supply tubes 34 on the other side are connected to the four sub tanks 3, respectively. The inks L in the four cartridges 2 are supplied to the buffer tanks 41 through the sub tanks 3 and the supply tubes 34.

The plurality of nozzles 42 are in communication with the inside of the buffer tanks 41. The inks L retained in the buffer tanks 41 are discharged onto recording paper or paper P from the plurality of nozzles 42. The plurality of nozzles 42 form four nozzle arrays aligned in the left/right direction. Each nozzle array extends in the front/rear direction. From the four nozzle arrays, the inks L of black, yellow, cyan and magenta are discharged in the alignment order from the right side. Note that the head unit 4 is provided with unshown piezo elements for applying discharging energy to the inks L in the respective nozzles 42.

The platen 40 is a member shaped into a rectangular plate to support the paper P thereon. Above the platen 40, two guide rails 15 and 16 are provided to extend parallel to the left/right direction (or scanning direction). The carriage 5 is fitted on the two guide rails 15 and 16. The carriage 5 is movable in the left/right direction along the guide rails 15 and 16 in the area facing the platen 40.

Further, a drive belt 17 is fitted on the carriage 5. The drive belt 17 is an endless belt stretched on two pulleys 18 and 19 to surround the same. The pulley 18 of the two is linked to a carriage motor 50 (see FIG. 4). The carriage motor 50 drives the pulley 18 to rotate forwardly or backwardly such that the drive belt 17 is caused to move along. By virtue of this, the carriage 5 reciprocates in the left/right direction. On this occasion, the head unit 4 mounted on the carriage 5 also reciprocates in the left/right direction.

The paper P supported on the platen 40 is conveyed by the paper feed roller 7 and the paper discharge roller 8 to the front side of the liquid discharging apparatus 1 (in the conveyance direction). A conveyance motor 70 (see FIG. 4) drives the paper feed roller 7 and the paper discharge roller 8 to rotate in a cooperating manner. The liquid discharging apparatus 1 records a desired image or the like on the paper P by alternately repeating the operation to convey the paper P in the conveyance direction with the paper feed roller 7 and the paper discharge roller 8, and the discharging operation to discharge the inks L while moving the head unit 4 in the left/right direction (the scanning direction) together with the carriage 5.

<Detailed Configuration of the Cartridge and the Sub Tank>

Figure 2:
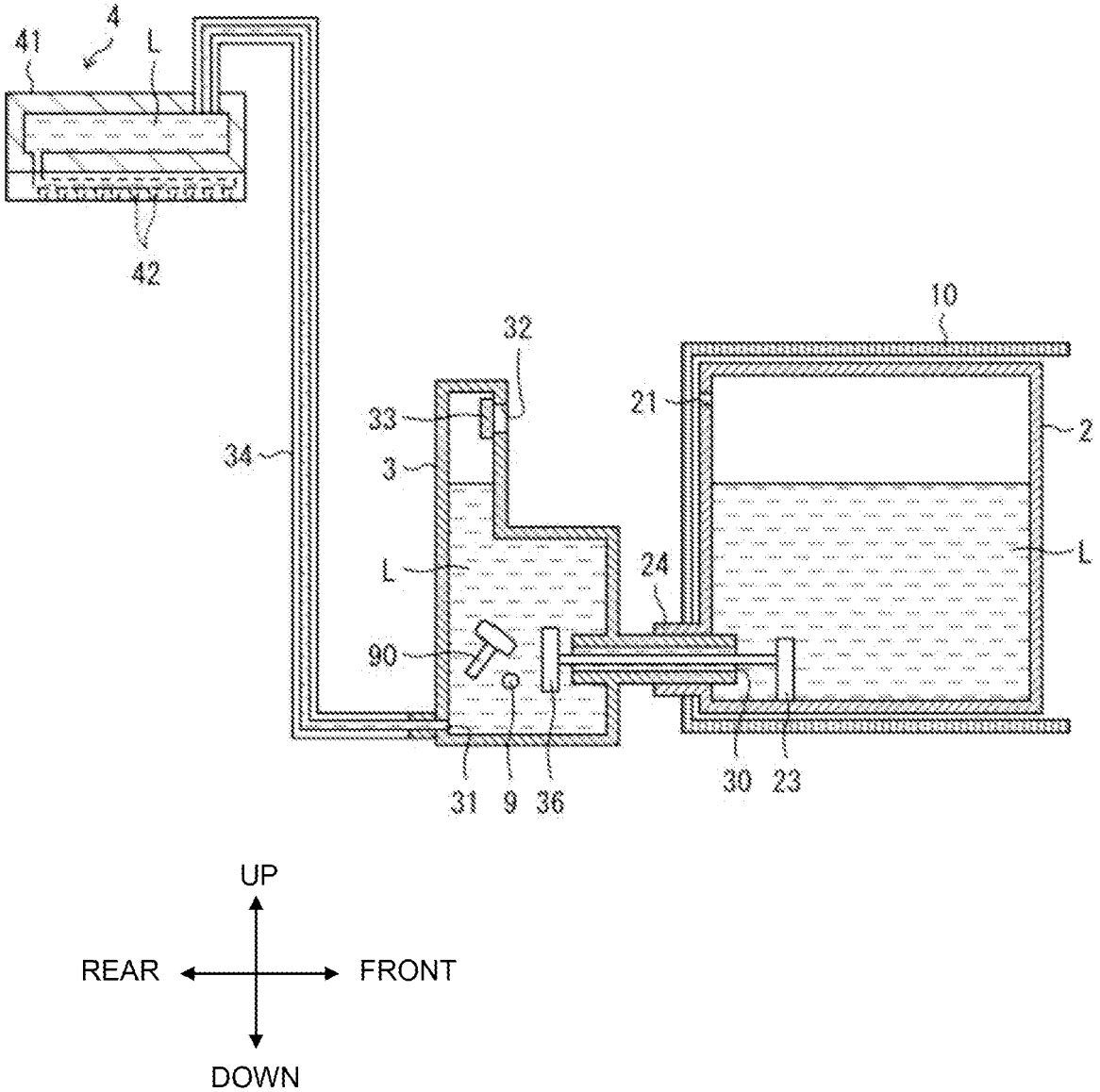
FIG. 2 depicts a periphery of a cartridge and a sub tank depicted in FIG. 1.

Next, referring to FIG. 2, a detailed explanation will be made on a detailed configuration of the cartridge and the sub tank. As depicted in FIG. 2, one cartridge 2 is installed in the tank installation unit 10 and positioned to be adjacent to the sub tank 3 in the front/rear direction.

The cartridge 2 is a box-like member in which the ink L is retained. Four such cartridges 2 are provided to retain the aforementioned inks L of the four colors respectively. A connecting port 24 is formed in a lower portion of each cartridge 2 at the rear side to penetrate through in the front/rear direction. This connecting port 24 is an opening for supplying the ink L in the cartridge 2 to an external part, and has an unshown valve mechanism. This valve mechanism operates to open the connecting port 24 on the occasion of the cartridge 2 being installed into the sub tank 3, and to close the connecting port 24 on the occasion of the cartridge 2 being removed from the sub tank 3. Note that FIG. 2 depicts only one of the four cartridges 2.

Further, a contact member 23 is arranged on the bottom of the cartridge 2 to contact with an aftermentioned opening and closing member 36.

An atmosphere communication port 21 is formed in an upper portion of the cartridge 2 at the rear side to penetrate through in the front/rear direction. The gas layer above the liquid level of the ink L in the cartridge 2 is in communication with the outside (the atmosphere) via the atmosphere communication port 21.

Next, the sub tanks 3 will be explained. The four sub tanks 3 correspond respectively to the four cartridges 2. Each sub tank is a box-like member which temporarily retains the ink L supplied from the corresponding cartridge 2. That is, the four sub tanks 3 respectively retain the inks L of the aforementioned four colors. As depicted in FIG. 2, the sub tank 3 is smaller in volume than the cartridge 2. Further, a connecting tube having a supply port 30 is provided in a lower portion of the sub tank 3 at the front side. This supply port 30 allows for supply of the ink L from the cartridge 2 therethrough.

The opening and closing member 36 is arranged at the supply port 30 for opening or closing the supply port 30. The opening and closing member 36 is biased frontward (rightward in FIG. 2) by an elastic member such as a spring or the like to usually close the supply port 30. The opening and closing member 36 allows for an open state of the supply port 30 when the cartridge 2 is connected to the sub tank 3 to allow a part of the sub tank 3 to contact with the contact member 23 arranged in the cartridge 2. On the other hand, the opening and closing member 36 allows for a closed state of the supply port 30 when the cartridge 2 is removed from the sub tank 3 such that the cartridge 2 is no longer connected to the sub tank 3.

An outflow port 31 is formed in a lower portion of the sub tank 3 at the rear side. The outflow port 31 is an opening for the ink L retained in the sub tank 3 to flow to the outside. The outflow port 31 is connected with a supply tube 34. The ink L retained in the sub tank 3 is supplied to the head unit 4 via the supply tube 34. The outflow port 31 is arranged below the supply port 30.

A communication hole 32 is formed in an upper portion of the sub tank 3 at the front side for communication with the outside. A semipermeable membrane 33 is disposed to cover the communication hole 32 such that gas is allowed to pass through the semipermeable membrane 33 and liquid is prevented from passing through the semipermeable membrane 33. The ink L may attach to the semipermeable membrane 33 if the liquid discharging apparatus 1 happens to waggle or slant. If the adhered ink L is dried, etc., and thereby caked, then the semipermeable membrane 33 may be clogged up. In the following explanation, the term "the semipermeable membrane in a blocked state" will refer to such a state that gas can no longer permeate or pass there because the semipermeable membrane 33 is clogged up. If the semipermeable membrane is in the blocked state, then the ink L can no longer be discharged normally from the nozzles 42.

As depicted in FIG. 2, the remaining amount detector 9 is arranged in the sub tank 3 to detect the amount of the ink L in the sub tank 3. The remaining amount detector 9 is an optical sensor of a transmission type having unshown light emitting unit and light receiving unit. If the ink L in the sub tank 3 reaches or exceeds a predetermined amount, then a float 90 ascends such that the light emitted from the light emitting unit is received by the light receiving unit. On the other hand, if the ink L in the sub tank 3 falls below the predetermined amount, then the float 90 descends such that the light emitted from the light emitting unit is not received by the light receiving unit. In this manner, if the remaining amount detector 9 detects that equal to or more than the certain intensity of light is received, then the remaining amount detector 9 outputs a signal to the controller 100 (see FIG. 4). Based on the signal from the remaining amount detector 9, the controller 100 determines whether or not the residual or remaining amount of the ink L in the sub tank 3 is kept equal to or more than the predetermined amount.

<Configuration of the Periphery of a Cap Portion>

Figure 3:
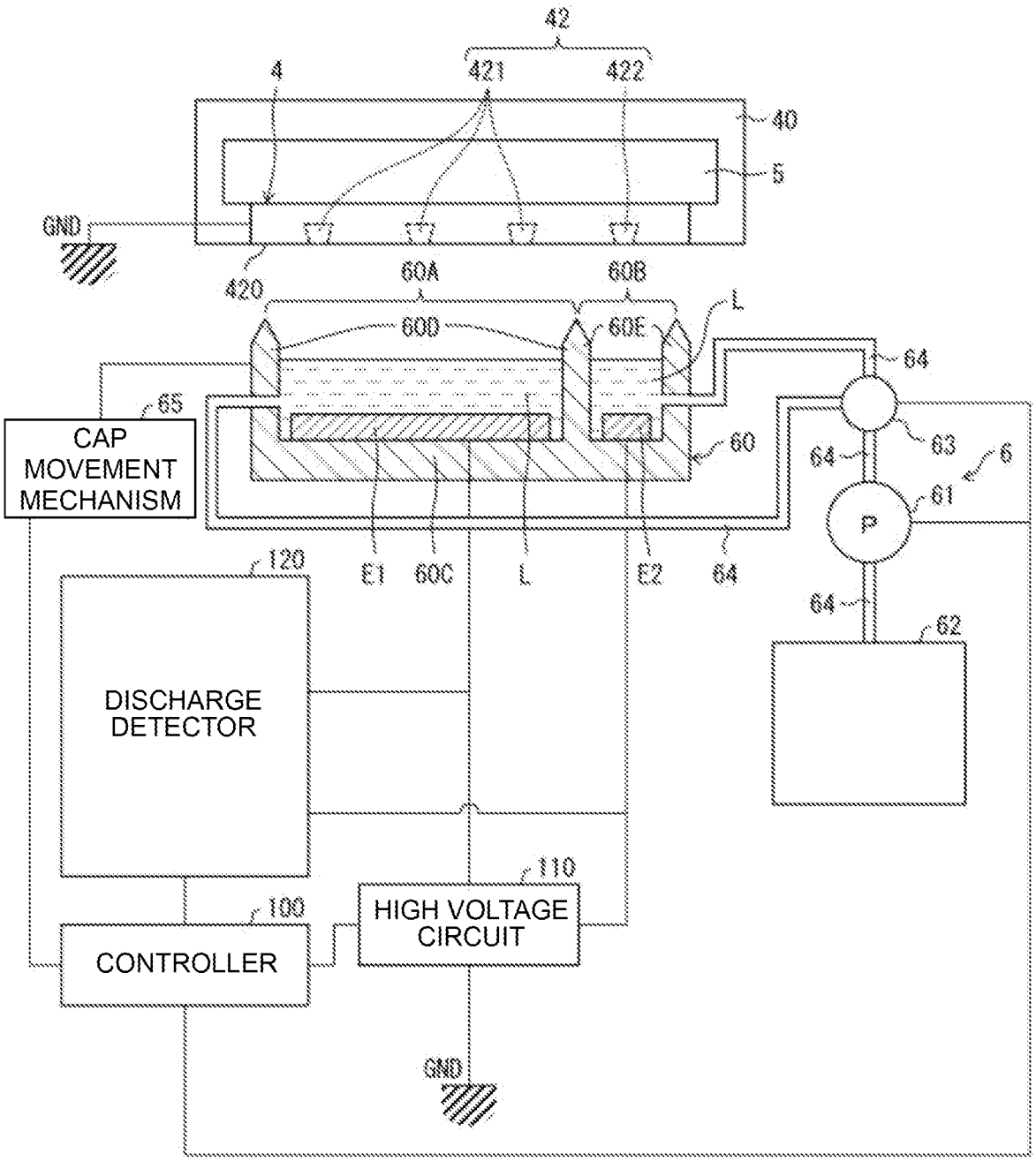
FIG. 3 depicts a configuration of the periphery of a cap portion depicted in FIG. 1.

As depicted in FIG. 3, in the periphery of the cap portion 60, there are provided the head unit 4, the suction mechanism 6, a waste liquid tank 62 (corresponding to the waste liquid storage), a first electrode E1 and a second electrode E2 (corresponding to the electrode), and a cap movement mechanism 65.

As depicted in FIG. 1, the cap portion 60 is arranged to deviate in position from the platen 40 in the scanning direction. From the state depicted in FIG. 1, as the carriage 5 has moved to the right side of the platen 40, as depicted in FIG. 3, a nozzle surface 420 of the head unit 4 and the cap portion 60 face each other in the up/down direction.

Each nozzle 42 has first nozzles 421 discharging the inks L of the three colors of yellow, cyan and magenta, and a second nozzle 422 discharging the ink L of black. Hereinbelow, the term "suction position" will be used to refer to the position where the nozzle surface 420 of the head unit 4 faces the cap portion 60.

The cap portion 60 is formed of a rubber material, for example, and installed in contact with the head unit 4. If the cap portion 60 is installed to the head unit 4, then the cap portion 60 covers the nozzles 42, which are then blocked. The cap portion 60 is configured to be ascendible and descendible in the up/down direction, with the cap movement mechanism 65 (see FIG. 3) driving the same.

The cap portion 60 has a first cap portion 60A and a second cap portion 60B. The first cap portion 60A has first lips 60D. The first cap portion 60A covers the first nozzles 421 with first lips 60D to seal up the first nozzles 421. The first lips 60D project upward from a bottom 60C of the cap portion 60 to enclose the first electrode E1. The first electrode E1 is constructed of an electrically conductive material having a rectangular plan shape.

The second cap portion 60B has second lips 60E. The second cap portion 60B covers the second nozzle 422 with second lips 60E to seal up the second nozzle 422. The second lips 60E project upward from the bottom 60C of the cap portion 60 to enclose the second electrode E2. Note that the second lips 60E and the first lips 60D share in part with each other. The second electrode E2 is also constructed of an electrically conductive material having a rectangular plan shape.

The cap movement mechanism 65 is configured to have a motor, gears and a cam mechanism all of which are not depicted. The motor drives the gears, which drive the cam mechanism. Then, the cam mechanism is driven to displace the cap portion 60. That is, the cap movement mechanism 65 displaces the cap portion 60 to cause the head unit 4 to contact with or depart from the first lips 60D of the first cap portion 60A and the second lips 60E of the second cap portion 60B.

The carriage 5 is arranged in the suction position and, when the nozzles 42 face the cap portion 60, if the cap movement mechanism 65 causes the cap portion 60 to ascend, then the first lips 60D and the second lips 60E of the cap portion 60 attach tightly to the nozzle surface 420. By virtue of this, the first nozzles 421 are covered by the first cap portion 60A and the second nozzle 422 is covered by the second cap portion 60B.

Note that the cap portion 60 is not limited to a configuration of covering the nozzles 42 by attaching tightly to the nozzle surface 420. For example, the cap portion 60 may cover the nozzles 42 by attaching tightly to an unshown frame or the like arranged around the nozzle surface 420 of the head unit 4.

The suction mechanism 6 has a suction pump 61 and a switcher 63 configured to discharge the inks L in the cap portion 60 to the waste liquid tank 62. The suction pump 61 is a tube pump having a motor and gears unshown, for example, to suck the gas and liquid in the cap portion 60 by the driving of the tube pump. The suction pump 61 is connected with the switcher 63 and the waste liquid tank 62 via a tube 64. The switcher 63 has a flow channel switch valve made of rubber, a motor, and gears, wherein the motor is adapted to drive the low channel switch valve. The switcher 63 is connected with the first cap portion 60A and the second cap portion 60B via the tube 64.

The switcher 63 switches between the flow channel from the first cap portion 60A to the suction pump 61, and the flow channel from the second cap portion 60B to the suction pump 61. With the switcher 63, the suction mechanism 6 selectively discharges the inks L in the first cap portion 60A and the second cap portion 60B to the waste liquid tank 62. The waste liquid tank 62 retains the inks L discharged out of the cap portion 60 by the suction mechanism 6.

The first electrode E1 and the second electrode E2 are electrically connected to a high voltage circuit 110 and a discharge detector 120 (corresponding to the second detector), as depicted in FIG. 3. The head unit 4 is connected to the ground (voltage) GND and its (electric) potential is maintained in a state illimitably close to 0 V. On the other hand, the high voltage circuit 110 applies a potential about 600 V to the first electrode E1 and the second electrode E2. By virtue of this, a potential difference arises between the head unit 4 and the first electrode E1 and between the head unit 4 and the second electrode E2.

In this context, with the carriage 5 located in the suction position, if the inks L are discharged from the first nozzles 421 toward the first electrode E1, then the negatively charged inks L approach the first electrode E1. If the inks L land on the first electrode E1, then the first electrode E1 takes over the negative electrical charges, and thus its voltage value decreases. In the same manner, if the ink L is discharged from the second nozzle 422 toward the second electrode E2, then the voltage value of the second electrode E2 decreases.

In the first embodiment, by letting the discharge detector 120 detect the decrease of the voltage value of the electrode E1 along with the discharge of the inks L as described above, it is detected that the inks L are discharged from the first nozzles 421 toward the first electrode E1. In the same manner, by letting the discharge detector 120 detect the decrease of the voltage value of the electrode E2 along with the discharge of the ink L as described above, it is detected that the ink L is discharged from the second nozzle 422 toward the second electrode E2. In particular, the discharge detector 120 determines whether the first electrode E1 or the second electrode E2 has a voltage lower than a threshold value Va, so as to detect whether the inks L are discharged toward the first electrode E1 or the ink L toward the second electrode E2 from the nozzles 42 (see FIG. 9).

That is, if the inks L are discharged toward the first electrode E1 or the ink L toward the second electrode E2 from the nozzles 42, then the first electrode E1 or the second electrode E2 has a voltage lower than the threshold value Va. On the other hand, if neither the inks L are discharged toward the first electrode E1 nor the ink L toward the second electrode E2 from the nozzles 42, then the first electrode E1 and the second electrode E2 have almost no change in voltage value.

In the first embodiment, if the semipermeable membrane 33 arranged in the communication hole 32 of the sub tank 3 is blocked by the caked ink L, then the suction mechanism 6 carries out a suction purge to bring about a negative pressure in the sub tank 3, thereby excluding the caked ink L adhered to the semipermeable membrane 33. Then, if the discharge detector 120 detects that the ink L is discharged from the nozzles 42 normally again, then it is confirmed that the semipermeable membrane 33 is released from the blocked state.

<Electrical Configuration of the Liquid Discharging Apparatus>

As depicted in FIG. 4, the controller 100 has a CPU (Central Processing Unit) 101, a ROM (Read Only Memory) 102, a RAM (Random Access Memory) 103, a nonvolatile memory 104, an ASIC (Application Specific Integrated Circuit) 105, and the like. The ROM 102 stores programs, various data and the like for the CPU 101 to control various operations. The RAM 103 is used as a storage area temporarily storing the data, signals and the like for the CPU 101 to use in executing the above programs, or as a working area for data processing.

The nonvolatile memory 104 has a remaining amount counter 104A storing the remaining ink amount which remains in the cartridge 2 and the sub tank 3 corresponding to each color, and a discharge amount counter 104B storing the total discharge amount of the ink L of each color discharged from the nozzles 42. The controller 100 calculates the amount of the discharged ink L when the ink L is discharged from the nozzles 42 due to printing images on the paper P, the suction purge and the like, and then updates the total discharge amount stored in the discharge amount counter 104B. Further, the controller 100 updates the remaining ink amount stored in the remaining amount counter 104A by subtracting the total discharge amount of the ink L from the initial retained amount of the ink L stored in the memory 200 of the cartridge 2.

The ASIC 105 is connected electrically with the head unit 4, the carriage motor 50, the conveyance motor 70, the cap movement mechanism 65, the suction pump 61, the switcher 63, the high voltage circuit 110, the installation detector 22, the remaining amount detector 9, the discharge detector 120, the display 130, the operation unit 140, a communication interface (I/F) 150, and the like.

The display 130 has a liquid crystal display screen for example, to carry out various displays about printing, restoring process, and the like. For example, the display 130 displays a caution message for the user. The operation unit 140 is constructed from a touch panel for example, and configured to allow the user to operate by way of touch for various settings about printing. The communication I/F 150 is configured to carry out data communication with external devices and to send and receive processing requests of print jobs and the like. The controller 100 causes the apparatus to print images and the like on the paper P by controlling the head unit 4, the carriage motor 50, the conveyance motor 70 and the like on the basis of the received print jobs via the communication I/F 150. Further, the controller 100 carries out the suction purge to be described later on by controlling the cap movement mechanism 65, the suction pump 61, the switcher 63, and the like.

The installation detector 22 is a sensor for detecting whether or not each sub tank 3 is connected with the corresponding cartridge 2. The installation detector 22 outputs an ON signal to the controller 100 if the cartridge 2 is installed to the sub tank 3 but outputs an OFF signal to the controller 100 if the cartridge 2 is not installed to the sub tank 3.

<Control Operation of the Controller>

Figure 5:
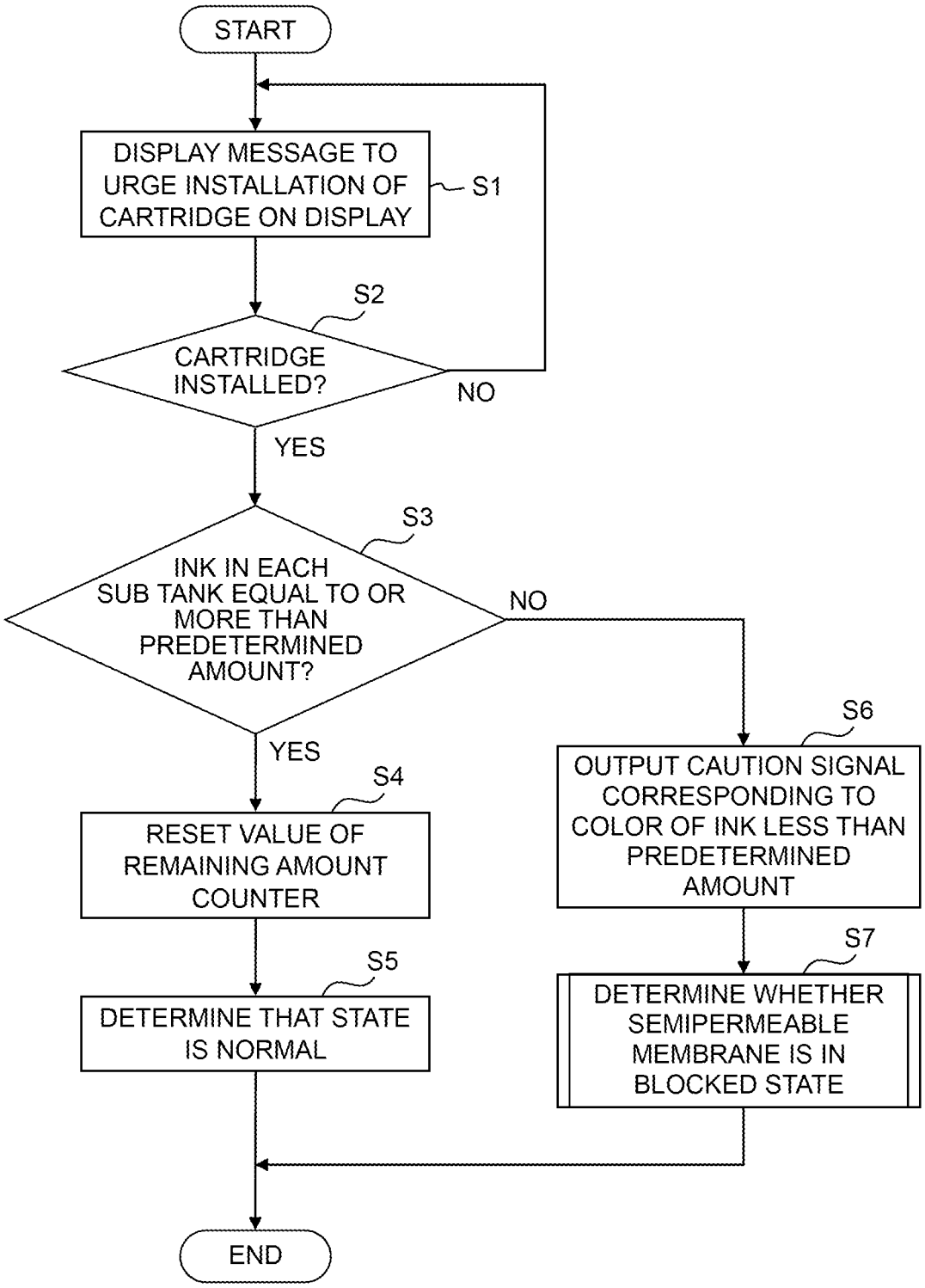
FIG. 5 is a flow chart depicting a control operation when the cartridge is installed into the liquid discharging apparatus according to the first embodiment.
Figure 6:
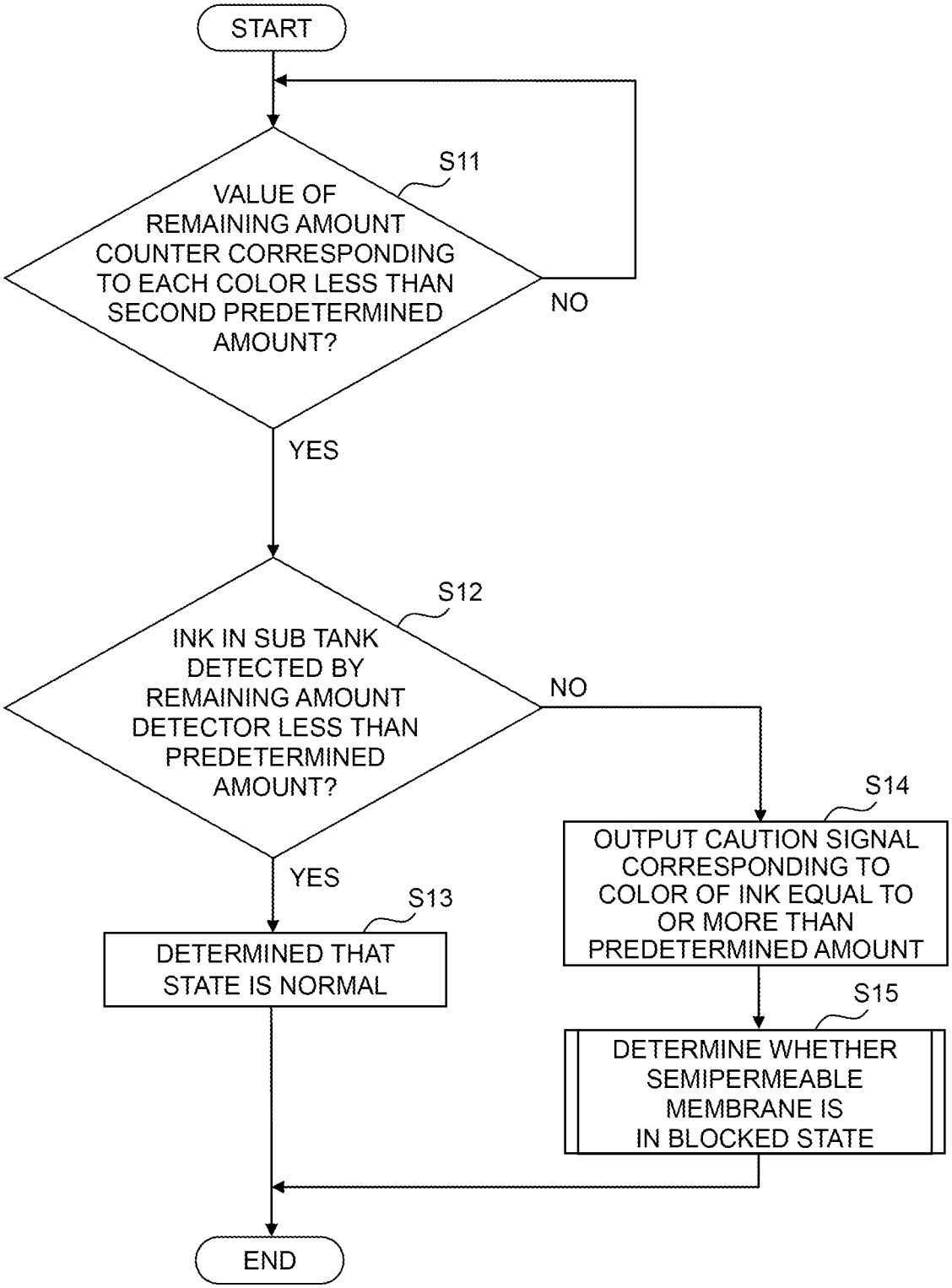
FIG. 6 is a flow chart depicting a control operation when the ink in the cartridge decreases in the liquid discharging apparatus according to the first embodiment.

Next, referring to the flow charts of FIGS. 5 to 8, an explanation will be made on the control operation of the controller 100 of the liquid discharging apparatus 1 according to the first embodiment. FIGS. 5 and 6 are the flow charts for determining the possibility of the semipermeable membrane 33 being in the blocked state. The restoring process for the semipermeable membrane 33 is started with any of those flow charts as the starting point.

As depicted in FIG. 5, first, the controller 100 displays a message on the display 130 to urge for installation of a cartridge 2 (S1). By confirming the message on the display 130, the user starts to install the cartridge 2 to the tank installation unit 10. Next, based on the receipt of a detection signal from the installation detector 22, the controller 100 determines whether or not the cartridge 2 is installed (S2). If the cartridge 2 is not yet installed (S2: No), then the process returns to the step S1, whereas if the cartridge 2 is installed (S2: Yes), then the process proceeds to the step S3.

In the step S3, based on a detection signal from the remaining amount detector 9, the controller 100 determines whether or not the amount of the ink L in each sub tank 3 is equal to or more than a predetermined amount (S3). For example, the controller 100 determines whether the detection signal from the remaining amount detector 9 changes within a predetermined time since the installation of the cartridge 2 has been detected, or the controller 100 determines whether the detection signal from the remaining amount detector 9 changes after the predetermined time has elapsed. If the detection signal from the remaining amount detector 9 changes, the controller 100 determines that the amount of the ink L in each sub tank 3 is equal to or more than the predetermined amount (S3: Yes). In this case, the controller 100 resets the remaining amount counter 104A (S4) and determines it as in the normal state (S5). With that, the process of the flow depicted in FIG. 5 is ended.

On the other hand, if the detection signal from the remaining amount detector 9 does not change (S3: No), the controller 100 determines that the amount of the ink L in any sub tank 3 is less than the predetermined amount. In this case, the controller 100 outputs a caution signal corresponding to the color whose ink L is less than the predetermined amount (S6). In particular, the controller 100 displays a caution message on the display 130, for example. Then, the controller 100 carries out a "determination of the semipermeable membrane in the blocked state" (S7).

Note that the processing flow of the steps S1 to S7 in FIG. 5 described above is carried out when the ink L in the sub tank 3 does not rise up to the predetermined amount even if a new cartridge 2 is installed. This is because of concerning about the situation that the semipermeable membrane 33 may fall into the blocked state. In more detailed explanation, if the semipermeable membrane 33 is blocked, then the air inside the sub tank 3 cannot be released out. Therefore, when the ink L in the sub tank 3 is less than the predetermined amount, even if the new cartridge 2 having the ink L sufficiently is connected, it is still difficult to conduct the ink L into the sub tank 3. Hence, the ink L inside the sub tank 3 will not reach the predetermined amount.

In the flow chart depicted in FIG. 6, it is assumed that any one of the four cartridges 2 has a small remaining amount of the ink L.

As depicted in FIG. 6, first, the controller 100 determines whether or not the value of the remaining amount counter 104A, which is an estimated value of the remaining amount of the ink L corresponding to each color, is less than a second predetermined value smaller than the above predetermined value (S11). On this occasion, the "second predetermined value" refers to such an amount as able to print 200 pieces of paper, for example, with the ink L in the cartridge 2 and the sub tank 3 corresponding to any one of the four colors.

If the value of the remaining amount counter 104A is equal to or more than the second predetermined amount for all of the four colors (S11: No), then the process returns to the step S11. On the other hand, if the value of the remaining amount counter 104A for any one color is less than the second predetermined value (S11: Yes), then the controller 100 determines whether or not the ink L in the sub tank 3 detected by the remaining amount detector 9 is less than the predetermined amount for the color whose value of the remaining amount counter 104A is determined as less than the second determined value (S12).

On this occasion, the controller 100 determines that the estimated value of the remaining ink amount is equal to the sensor value if the estimated value of the remaining ink amount is less than the second predetermined amount and if the sensor value by the remaining amount detector 9 detecting the actual ink amount is also less than the predetermined amount. On the other hand, the controller 100 determines that the estimated value of the remaining ink amount is not equal to the sensor value if the estimated value of the remaining ink amount is less than the second predetermined amount but if the sensor value by the remaining amount detector 9 is equal to or more than the predetermined amount.

If the ink L in the sub tank 3 is less than the predetermined amount (S12: Yes), then the controller 100 determines that it is in the normal state (S13). That is, the controller 100 determines that the remaining amount of the ink L in the sub tank 3 estimated from the value of the remaining amount counter 104A is equal to the amount of the ink L in the sub tank 3 detected by the remaining amount detector 9.

On the other hand, if the ink L in the sub tank 3 is equal to or more than the predetermined amount (S12: No), then the controller 100 outputs the caution signal corresponding to the color the ink L of which is equal to or more than the predetermined amount (S14), and carries out the "determination of the semipermeable membrane in the blocked state" (S15). That is, the controller 100 determines that the remaining amount of the ink L in the sub tank 3 estimated from the value of the remaining amount counter 104A is not equal to the amount of the ink L in the sub tank 3 detected by the remaining amount detector 9. In this case, the controller 100 determines that gas is blocked from passing therethrough because the caked ink L stays adhered to the semipermeable membrane 33.

Figure 7A:
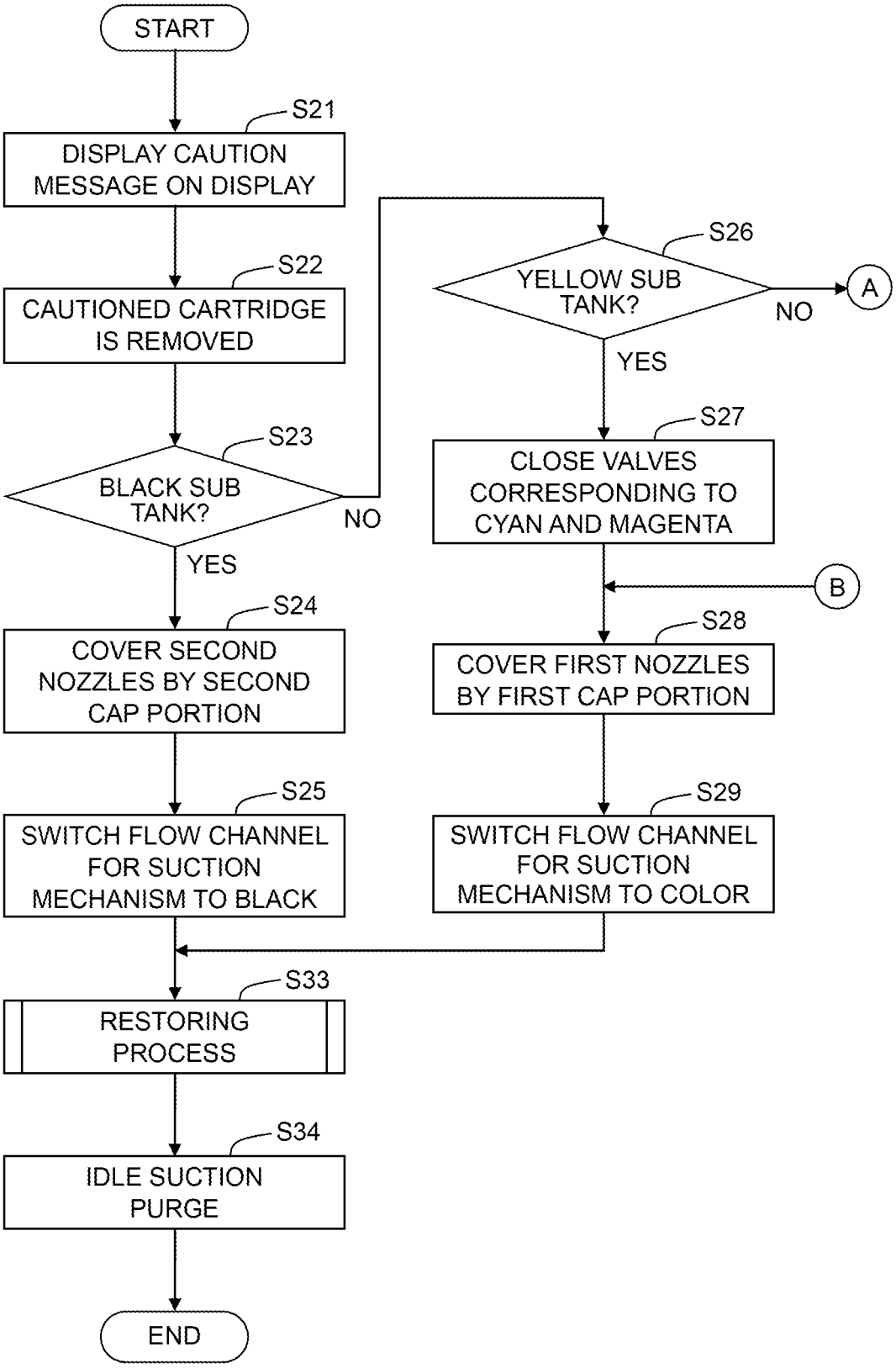
FIGS. 7A and 7B are a flow chart depicting the flow of a blocked state determination for a semipermeable membrane mentioned in FIGS. 5 and 6.
Figure 7B:
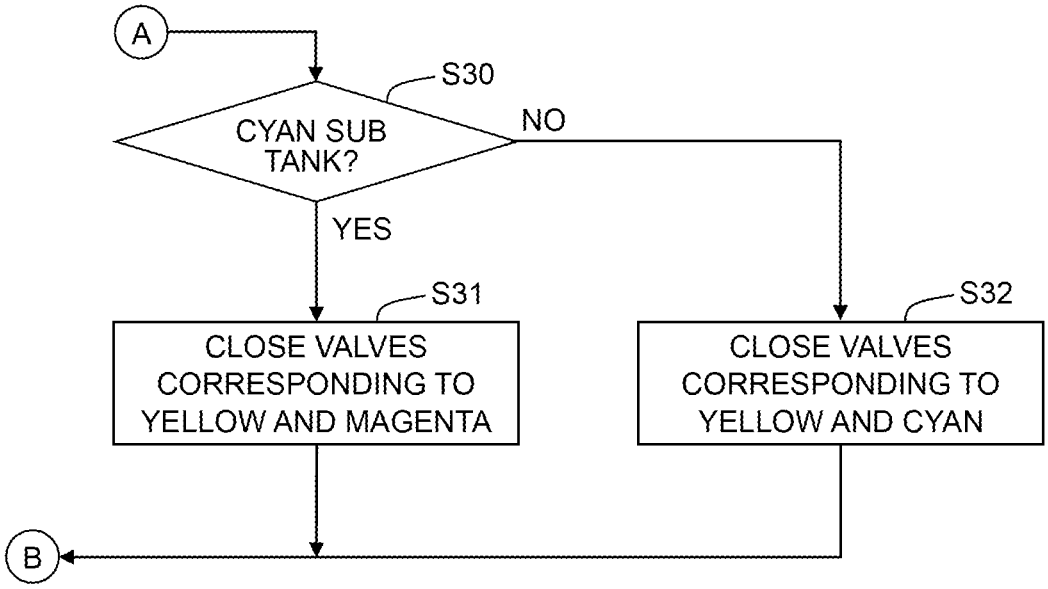

Next, referring to FIGS. 7A and 7B, an explanation will be made on the flow of the "determination of the semipermeable membrane in the blocked state" of the step S7 in FIG. 5 and the step S15 in FIG. 6. As depicted in FIGS. 7A and 7B, first, the display 130 displays the caution message (S21). In particular, in the step S6 in FIG. 5 and the step S14 in FIG. 6, the display 130 displays the caution message corresponding to the color for which the caution signal is outputted.

As the caution message, for example, the display 130 may display such as "please remove the cartridge of the black". The user confirms the caution message displayed on the display 130 and then removes the cartridge 2 of the black ink, for example, from the liquid discharging apparatus 1.

If the cartridge 2 is removed due to the caution therefor (S22), then the controller 100 determines whether or not the sub tank 3 without the cartridge 2 installed thereto is the sub tank 3 corresponding to the black ink (S23), based on the detection signal from the installation detector 22. If the sub tank 3 without the cartridge 2 installed thereto is the sub tank 3 corresponding to the black ink (S23: Yes), then the controller 100 installs the second cap portion 60B to the second nozzle 422 (S24).

In particular, the controller 100 drives the carriage motor 50 to move the carriage 5 and thus move the head unit 4 to the suction position. Then, the controller 100 drives the cap movement mechanism 65 to position the cap portion 60 to a predetermined posture such that the first lips 60D and the second lips 60E may contact with the nozzle surface 420 of the head unit 4.

Next, the controller 100 drives the switcher 63 to switch the flow channel for the suction mechanism 6 to the flow channel for the black ink (S25). After the step S25, the controller 100 carries out the restoring process of FIGS. 8A and 8B to be described later on (S33). After the step S33, the controller 100 carries out an empty suction purge (S34).

In the empty suction purge, with the cap portion 60 being apart from the nozzle surface 420, the controller 100 causes the switcher 63 to connect the cap portion 60 and the suction pump 61 to drive the suction pump 61. In this manner, by carrying out the empty suction purge, it is possible to discharge the inks L left in the cap portion 60 to the waste liquid tank 62.

If the sub tank 3 without the cartridge 2 connected thereto is not the sub tank 3 corresponding to the black ink (S23: No), then the controller 100 determines whether or not the sub tank 3 without the cartridge 2 connected thereto is the sub tank 3 corresponding to the yellow ink (S26), based on the detection signal from the installation detector 22. If the sub tank 3 without the cartridge 2 connected thereto is the sub tank 3 corresponding to the yellow ink (S26: Yes), then the controller 100 closes the valves of the supply tubes 34 corresponding to the cyan and magenta inks (S27), and installs the first cap portion 60A to the first nozzles 421 (S28). Then, the controller 100 controls the switcher 63 to switch the flow channel for the suction mechanism 6 to the flow channel for the color inks (S29). Note that in the step S27, instead of the controller 100 closing the valves of the supply tubes 34, the user may close the communication holes 32 of the sub tanks 3 corresponding to the cyan and magenta inks. After the step S29, the controller turns the process to the step S33.

In the step S26, if the sub tank 3 without the cartridge 2 connected thereto is not the sub tank 3 corresponding to the yellow ink (S26: No), then the controller 100 determines whether or not the sub tank 3 without the cartridge 2 connected thereto is the sub tank 3 corresponding to the cyan ink (S30), based on the detection signal from the installation detector 22. If the sub tank 3 without the cartridge 2 connected thereto is the sub tank 3 corresponding to the cyan ink (S30: Yes), then the controller 100 closes the valves of the supply tubes 34 corresponding to the yellow and magenta inks (S31), and the process turns to the step S28.

In the step S30, if the sub tank 3 without the cartridge 2 connected thereto is not the sub tank 3 corresponding to the cyan ink (S30: No), then the controller 100 closes the valves of the supply tubes 34 corresponding to the yellow and cyan inks (S32), and the process turns to the step S28.

Figure 8A:
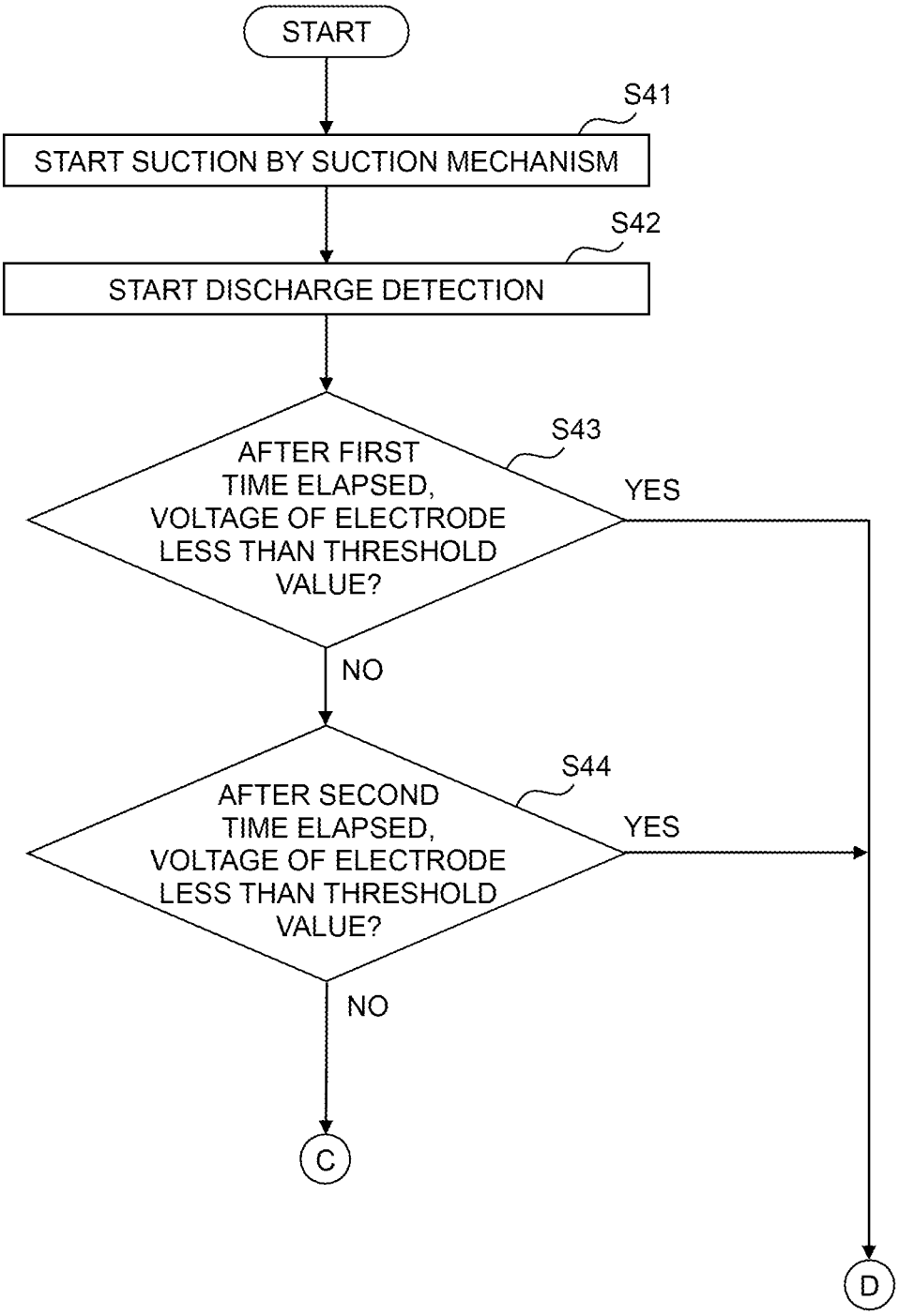
FIGS. 8A and 8B are a flow chart depicting the flow of a restoring process mentioned in FIG. 6.
Figure 8B:
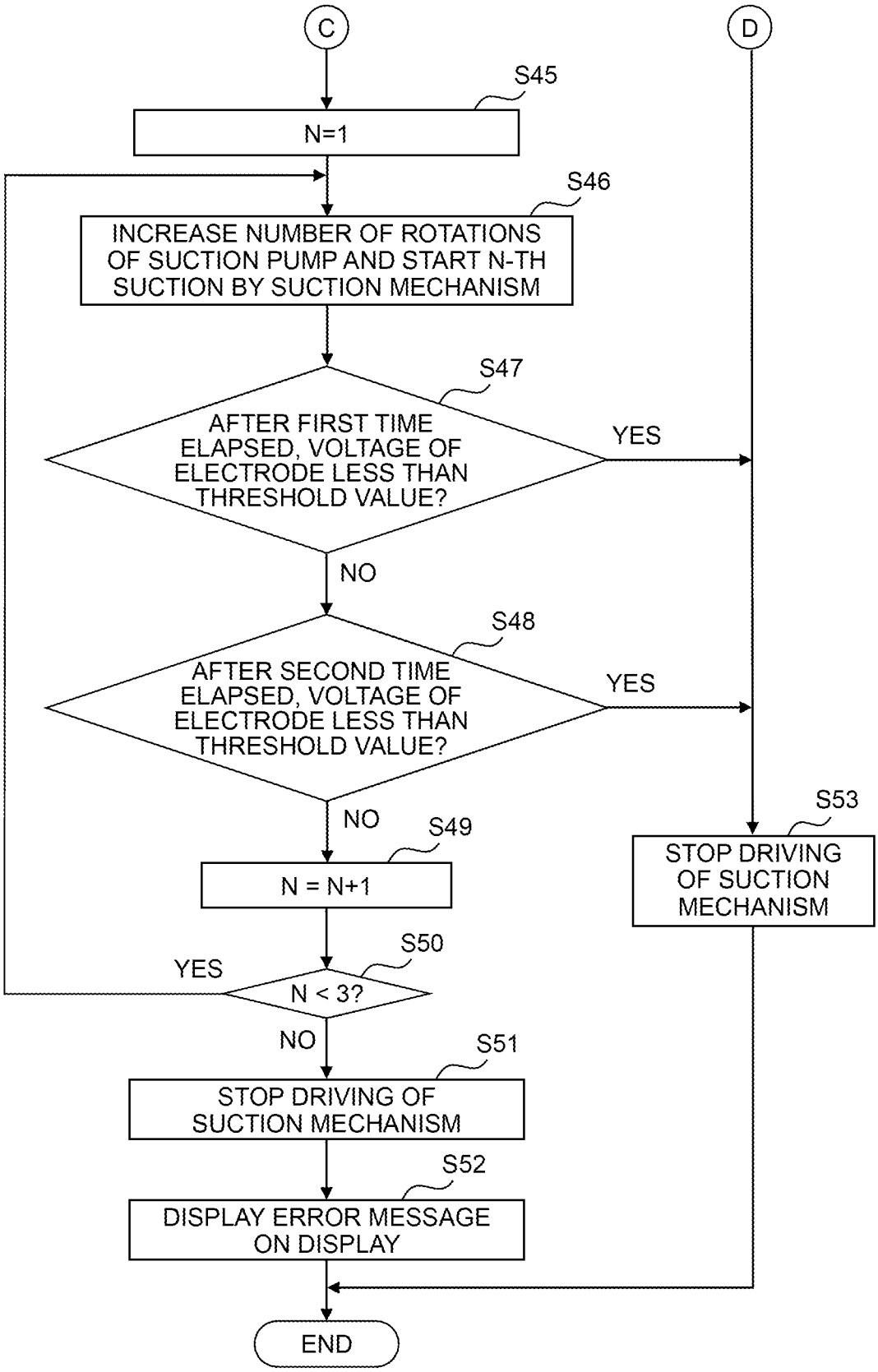
Figure 9:
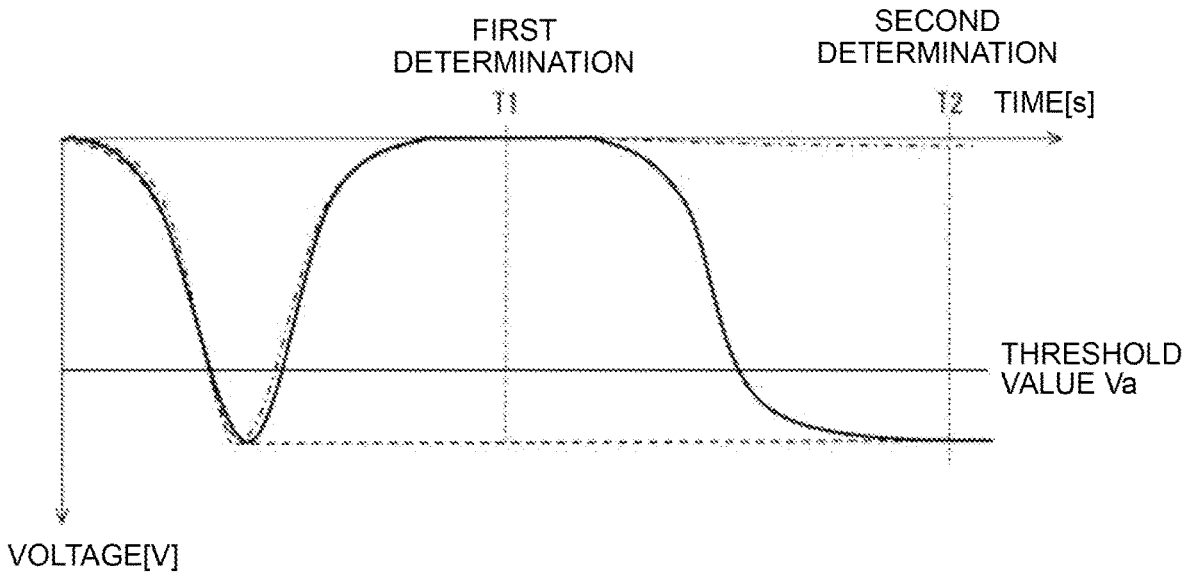
FIG. 9 is a graph depicting a voltage change of an electrode in detecting discharged liquid.

Next, referring to FIGS. 8A, 8B and 9, an explanation will be made on the restoring process of the step S33 in FIG. 7A. In this context, it is assumed that a caked ink L is adhered to the semipermeable membrane 33 arranged in the communication hole 32 of the sub tank 3 such that the semipermeable membrane 33 is in the blocked state. In the first embodiment, as will be depicted below, the suction mechanism 6 carries out the suction purge to apply a negative pressure to the inside of the sub tank 3, such that the caked ink L is removed to release the semipermeable membrane 33 from the blocked state.

First, the controller 100 displaces the cap portion 60 to the predetermined position as described earlier on, causes the suction mechanism 6 to start the suction (S41), and starts a discharge detection (S42). In particular, with the suction mechanism 6 being driven, the controller 100 causes the discharge detector 120 to detect an electrical change or a voltage change of the electrode (the first electrode E1 or the second electrode E2) arising from a change in the discharge state, from the state where the ink L is not discharged from the head unit 4 toward the electrode (the first electrode E1 or the second electrode E2).

In the step S43, the controller 100 determines whether or not the voltage of the electrode (the first electrode E1 or the second electrode E2) is less than the threshold value Va after a first time T1 (5 seconds for example) has elapsed since the start of suction (S43). The determination of the step S43 corresponds to the first determination in the graph of FIG. 9.

In the step S43, if the voltage of the electrode (the first electrode E1 or the second electrode E2) is less than the threshold value Va (S43: Yes), then the controller 100 determines that the ink L is discharged from the head unit 4 toward the electrode (the first electrode E1 or the second electrode E2). That is, it is determined that the nozzles 42 have become normal in discharging the ink L because the semipermeable membrane 33 is released from the blocked state as described earlier on such that gas is allowed to pass therethrough (see the broken line in FIG. 9). Then, the controller 100 stops driving the suction mechanism 6 (S53). In particular, the controller 100 stops the suction pump 61 from operating.

On the other hand, during the first time T1, if the voltage of the electrode (the first electrode E1 or the second electrode E2) is equal to or more than the threshold value Va (S43: No), then the controller 100 determines that the semipermeable membrane 33 is not released from the blocked state such that the suction mechanism 6 continues the suction purge. Then, the controller 100 determines whether or not the voltage of the electrode (the first electrode E1 or the second electrode E2) is less than the threshold value Va after a second time T2 (10 seconds for example) has elapsed since the start of suction (S44). The determination of the step S44 corresponds to the second determination in the graph of FIG. 9.

In the step S44, if the voltage of the electrode (the first electrode E1 or the second electrode E2) is less than the threshold value Va (S44: Yes), then the controller 100 determines that the ink L is discharged from the head unit 4 toward the electrode (the first electrode E1 or the second electrode E2). That is, it is determined that the nozzles 42 have become normal in discharging the ink L because the semipermeable membrane 33 is released from the blocked state as described earlier on such that gas is allowed to pass therethrough (see the broken line in FIG. 9). Then, the controller 100 stops driving the suction mechanism 6 (S53).

On the other hand, during the second time T2, if the voltage of the electrode (the first electrode E1 or the second electrode E2) is equal to or more than the threshold value Va (S44: No), then the controller 100 determines that the semipermeable membrane 33 is not released from the blocked state such that the process proceeds to the step S45.

In the step S45, the controller 100 causes the RAM 103 to store a flag "N=1", raises the number of rotations of the suction pump 61, and starts the nth suction (which is the first suction in the present case) of the suction mechanism 6 (S46).

Next, the controller 100 determines whether or not the voltage of the electrode (the first electrode E1 or the second electrode E2) is less than the threshold value Va after the first time T1 has elapsed since the start of suction (to be referred to below as intensive suction purge) with the suction pump 61 whose number of rotations is raised (S47). In the step S47, if the voltage of the electrode (the first electrode E1 or the second electrode E2) is less than the threshold value Va (S47: Yes), then the controller 100 determines that the nozzles 42 are normal in discharging the ink L. That is, it determines that the semipermeable membrane 33 is released from the blocked state such that gas is allowed to pass therethrough (see the broken line in FIG. 9). Then, the controller 100 stops driving the suction mechanism 6 (S53).

On the other hand, during the first time T1, if the voltage of the electrode (the first electrode E1 or the second electrode E2) is equal to or more than the threshold value Va (S47: No), then the controller 100 determines that the semipermeable membrane 33 is not released from the blocked state such that the suction mechanism 6 continues the suction purge. Then, the controller 100 determines whether or not the voltage of the electrode (the first electrode E1 or the second electrode E2) is less than the threshold value Va after the second time T2 has elapsed since the start of suction (S48).

In the step S48, if the voltage of the electrode (the first electrode E1 or the second electrode E2) is less than the threshold value Va (S48: Yes), then the controller 100 determines that the nozzles 42 have become normal in discharging the ink L because the semipermeable membrane 33 is released from the blocked state such that gas is allowed to pass therethrough (see the solid line in FIG. 9). Then, the controller 100 stops driving the suction mechanism 6 (S53).

On the other hand, during the first time T2, if the voltage of the electrode (the first electrode E1 or the second electrode E2) is equal to or more than the threshold value Va (S48: No), then the controller 100 determines that the semipermeable membrane 33 is not released from the blocked state such that the cap portion 60 is caused to stand by for a certain period of time and positioned in the predetermined posture as it is where the first lips 60D and the second lips 60E are in contact with the head unit 4. Then, the process proceeds to the step S49.

In the step S49, the controller 100 causes the RAM 103 to store the flag "N=N+1", and determines whether or not N<3 (S50). In this moment, because N=2<3 (S50: Yes), the process returns to the step S46 to carry out the steps S47 and S48 in the same manner as above.

Then, in the step S50, if N=3 (S50: Yes), then the suction mechanism 6 is stopped from being driven (S51), and the display 130 displays an error message (S52). The error message may be, for example, displayed on the display 130 as "Need to repair the apparatus". In this manner, in the first embodiment, if the suction mechanism 6 has been driven a predetermined N number of times but, after the suction mechanism 6 is driven the Nth time, the discharge detector 120 has not detected that the nozzles 42 ever discharge the inks L normally even one time, then the error process is carried out to urge the user to change the cartridge 2 abnormal in ink discharge.

Note that in the first embodiment, when N=3 has reached, the intensive suction purge is stopped; however, without being limited to that, it is possible to change the number (N) of times as appropriate.

According to the liquid discharging apparatus 1 of the first embodiment explained above, if the controller 100 determines that there is no change in amount of the ink L retained in a sub tank 3 and thus the semipermeable membrane is in the blocked state, then by driving the suction mechanism 6 (S31), it is possible restore the semipermeable membrane 33 to recover from the blocked state. By virtue of this, it is possible to prevent the head unit 4 from failing to discharge the ink L. Further, if the controller 100 determines that the semipermeable membrane 33 has returned to the state allowing gas to pass therethrough, then by stopping the suction mechanism 6 from being driven (S37), it is possible to avoid needless suction.

Further, because it is possible for the opening and closing member 36 to close the supply port 30 between the sub tank 3 and the cartridge 2, by driving the suction mechanism 6, it is possible to preferably release the semipermeable membrane 33 from the blocked state.

Further, with the installation detector 22, it is possible to detect the connective condition between the cartridge 2 and the sub tank 3. By virtue of this, if the cartridge 2 is installed (S2: Yes), then the controller 100 can reset the remaining amount counter 104A (S4). Therefore, it is possible for the controller 100 to correctly estimate the remaining amount of the ink L in the cartridge 2 and the sub tank 3 with the remaining amount counter 104A.

Further, by appropriately setting a threshold value for discharge detection to detect whether or not the voltage of the electrode is less than the threshold value, it is possible to correctly determine whether or not the inks L are normally discharged from the nozzles 42.

Further, if the controller 100 carries out the discharge determination for the first time at the point after the first time T1 has elapsed since the start of driving the suction mechanism 6 (S43), and determines that the ink L is discharged (S43: Yes), then the suction mechanism 6 is stopped from being driven (S53). By virtue of this, it is possible to prevent the suction mechanism 6 from taking needless long time for suction. Further, if the controller 100 determines that the ink L is not discharged to any of the electrodes E1 and E2 (S43: No), then the suction mechanism 6 continues the suction whereby it is possible to release the semipermeable membrane 33 from the abnormal discharging state due to being blocked.

Further, if the controller 100 carries out the discharge determination for the second time at the point after the second time T2 has elapsed since the start of suction by the suction mechanism 6 (S44), and determines that the ink L is discharged (S44: Yes), then the suction mechanism 6 is stopped from being driven (S53). By virtue of this, it is possible to prevent the suction mechanism 6 from taking needless long time for suction. Further, if the controller 100 determines that the ink L is not discharged (S44: No), then the suction mechanism 6 continues the suction whereby it is possible to release the semipermeable membrane 33 from the abnormal discharging state due to being blocked.

Further, the controller 100 carries out the discharge determination for the second time after the second time T2 has elapsed since the suction mechanism 6 started the suction (S44) and, if it is determined that the ink L is not discharged (S44: No), then the controller 100 carries out the suction for the second time with the suction pump 61 whose number of rotations is raised (S46). By virtue of this, it is possible to preferably resolve the abnormal discharging state.

Further, after the suction mechanism 6 carries out the suction for the Nth time, if there has never been a discharge even once, then the controller 100 carries out the error process after stopping the suction mechanism 6 from being driven (S52). By virtue of this, it is possible for the user to recognize any abnormal discharging state.

Further, as depicted in FIGS. 7A and 7B, by determining the semipermeable membrane in the blocked state according to each color (type) of the inks L, it is possible to specify to which type of the inks L the sub tank 3 corresponds where the semipermeable membrane 33 has fallen in the blocked state.

Further, the controller 100 determines whether or not the ink L in the sub tank 3, which is detected by the remaining amount detector 9, is less than the predetermined amount, corresponding to the color where the value of the remaining amount counter 104A is less than the second predetermined value (S12). By virtue of this, it is possible to detect either of the following two abnormal cases: 1) due to the semipermeable membrane 33 of the sub tank 3 in the blocked state, there is a problem in supplying the ink L from the cartridge 2 to the sub tank 3; 2) regardless of a decrease of the value of the remaining amount counter 104A which is the estimated value of the remaining ink amount, the sensor value of the remaining amount detector 9 in the sub tank 3 does not decrease. Then, in those cases, it is possible for the controller 100 to determine that the semipermeable membrane 33 is in the blocked state (S7 and S15) and, by way of the suction of the suction mechanism 6, it is possible to restore the semipermeable membrane 33 to recover from the blocked state.

Second Embodiment

Next, referring to FIG. 10, an explanation will be made on a liquid discharging apparatus 1A according to a second embodiment of the present teaching. Note that for the sake of explanatory convenience, the same numerals or alphanumerals will be assigned to the members having the same functions as the members explained above in the first embodiment, and the explanations therefor will not be repeated.

Figure 10:
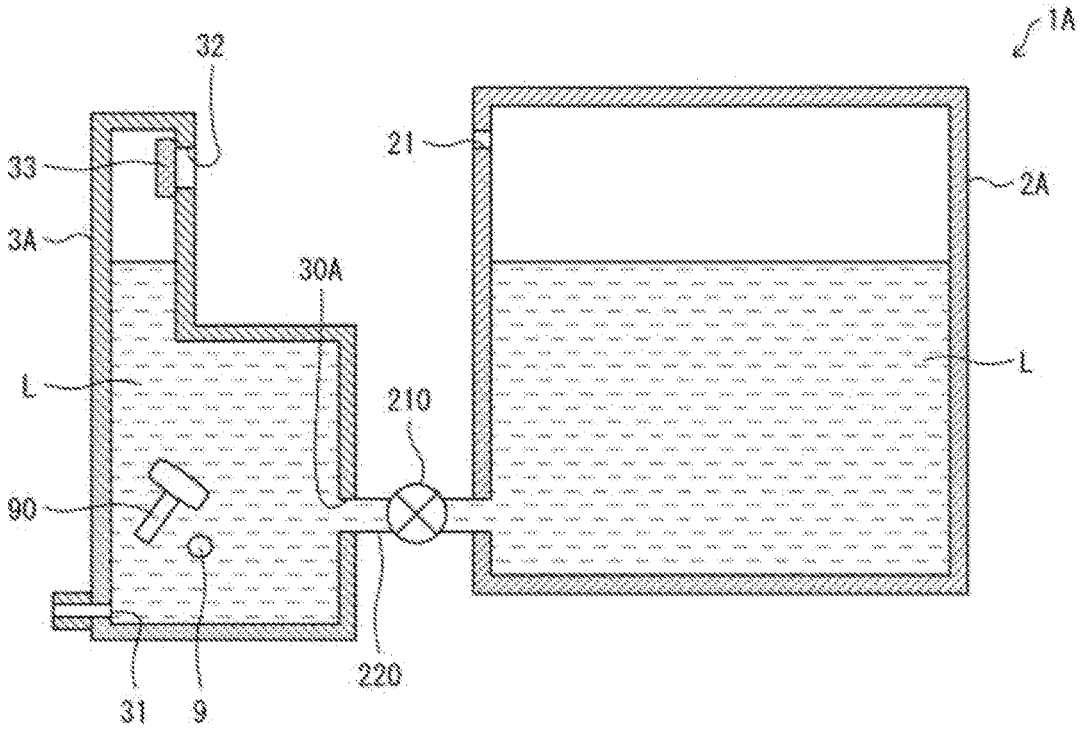
FIG. 10 depicts a connective relation between a cartridge and a sub tank in a liquid discharging apparatus according to a second embodiment of the present teaching.

As depicted in FIG. 10, in the second embodiment, a cartridge 2A and a sub tank 3A are connected via a connecting tube 220 which is provided with an opening and closing valve 210. The opening and closing valve 210 is, for example, an electromagnetic valve to open and close a supply port 30A.

The controller 100 opens the opening and closing valve 210 if the cartridge 2A is connected to the sub tank 3A, but closes the opening and closing valve 210 if cartridge 2A is disconnected from the sub tank 3. Then, for the liquid discharging apparatus 1A of the second embodiment, the same control operation as in the first embodiment is also carried out by the controller 100.

In the liquid discharging apparatus 1A of the second embodiment explained above, it is possible for the opening and closing valve 210 to close the supply port 30A between the sub tank 3A and the cartridge 2A. Therefore, by driving the suction mechanism 6, it is possible to preferably release the semipermeable membrane 33 from the blocked state.

Third Embodiment

Next, referring to FIG. 11, an explanation will be made on a liquid discharging apparatus 1B according to a third embodiment of the present teaching. Note that for the sake of explanatory convenience, the same numerals or alphanumerals will be assigned to the members having the same functions as the members explained above in the first embodiment, and the explanations therefor will not be repeated.

Figure 11:
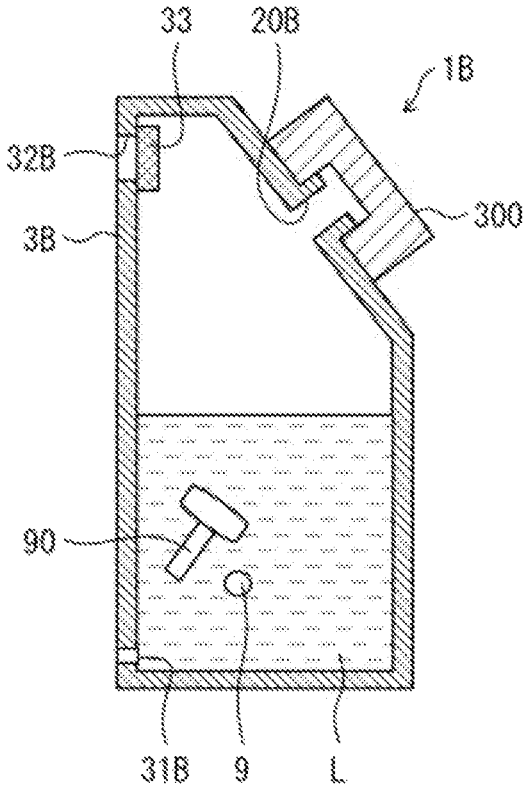
FIG. 11 depicts a configuration of a cartridge in a liquid discharging apparatus according to a third embodiment of the present teaching.

As depicted in FIG. 11, in the third embodiment, the ink L is supplied from each cartridge 3B of a bottle type (corresponding to the first storage) to the head unit 4. That is, the liquid discharging apparatus 1B according to the third embodiment is not provided with the cartridge 2 and the sub tank 3 as in the first embodiment.

The liquid discharging apparatus 1B is provided with four cartridges 3B. The four cartridges 3B retain the inks L of the four colors, respectively. An opening 20B is provided in an upper portion of each cartridge 3B at the front side. This opening 20B can be closed by a cap 300.

An outflow port 31B is provided in a lower portion of the cartridge 3B at the rear side. The ink L retained in the cartridge 3B is supplied to the head unit 4 via the outflow port 31B and the supply tube 34. A communication hole 32B is formed in an upper portion of the cartridge 3B at the rear side to communicate with the outside. The semipermeable membrane 33 is arranged in the communication hole 32B to disallow liquid to pass but allow gas to pass.

In the liquid discharging apparatus 1B of the third embodiment, too, the controller 100 carries out the control operation depicted in FIGS. 5 to 8 in the same manner as in the first embodiment. However, in the third embodiment, the cartridge 3B corresponds to the sub tank 3 of the first embodiment, without a configuration corresponding to the cartridge 2 (the first storage) of the first embodiment. Therefore, in the third embodiment, the controller takes the position of the cartridge 3B in controlling the cartridge 2 and the sub tank 3 in the flow charts of FIGS. 5 to 8.

The liquid discharging apparatus 1B of the third embodiment explained above can also obtain the same effects as those of the first embodiment. Especially, it is possible to prevent failure to discharge the inks L from the head unit 4 by a simple configuration, without needing to provide the two tanks for retaining the ink L.

OTHER EMBODIMENTS

In the above embodiments, the liquid discharging apparatus 1 is used in an ink jet printer of the serial type, which moves together with the carriage 5 in the scanning direction while discharging the inks L from the nozzles 42. However, without being limited to that, for example, the liquid discharging apparatus 1 may also be used in an ink jet printer of the line type, where the head unit 4 is fixed on the casing to extend through the entire length of the paper P in the scanning direction.

In the above embodiments, if the voltages of the electrodes E1 and E2 are less than the threshold value, then it is determined that the inks L are discharged normally from the nozzles 42. However, without being limited to that, for example, if a positive voltage is applied to the electrodes E1 and E2 and when the voltages of the electrodes E1 and E2 are equal to or more than a threshold value, then it may be determined that the inks L are discharged normally from the nozzles 42. Further, by detecting the absolute values of the voltages of the electrodes E1 and E2 and the current values flowing in the electrodes E1 and E2, it is also be possible to determine whether or not the inks L are discharged normally from the nozzles 42.

In the above embodiments, in the step S46, the number of rotations of the suction pump 61 is raised to carry out the intensive suction purge by the suction mechanism 6. However, without being limited to that, it is possible for the suction mechanism 6 to continue the suction without changing the number of rotations of the suction mechanism 6.

The present teaching is not limited to the embodiments described above but may undergo various changes and modifications without departing from the scope set forth in the appended claims. Any configurations obtained by appropriately combining the technical means disclosed in the embodiments are also included in the technical scope of the present teaching.

What is claimed is:

1. A liquid discharging apparatus comprising:

a first storage configured to store liquid;

a first detector configured to detect an amount of the liquid in the first storage;

a communication hole communicating the first storage and outside;

a semipermeable membrane arranged to cover the communication hole, the semipermeable membrane being configured to prevent the liquid from passing therethrough and to allow gas to pass therethrough;

a head unit having at least one nozzle configured to discharge the liquid supplied from the first storage;

a liquid flow channel configured to communicate the first storage and the head unit;

a cap having a lip and being configured to seal the nozzle of the head unit;

a cap movement mechanism configured to move the cap such that the lip of the cap contacts with and is separated from the head unit;

an electrode arranged in the cap and on which the liquid discharged from the nozzle is landed;

a second detector connected electrically to the electrode and configured to detect that the liquid is discharged from the nozzle toward the electrode;

a suction mechanism configured to suck the liquid and gas inside the cap;

a waste liquid storage configured to store the liquid sucked from inside of the cap by the suction mechanism; and a controller, wherein the controller is configured to:

under a condition that the first detector detects that there is no change in the amount of the liquid in the first storage, determine whether the semipermeable membrane is in a blocked state in which the gas is prevented from passing therethrough due to the liquid adhered to the semipermeable membrane;

under a condition that the semipermeable membrane is in the blocked state, drive the cap movement mechanism to position the cap to a predetermined posture in which the lip contacts with the head unit, and to drive the suction mechanism to discharge the gas and liquid inside the cap with the cap being positioned in the predetermined posture; and under a condition that the second detector detects an electrical change in the electrode caused by the liquid discharged from the nozzle toward the electrode in a state of the suction mechanism being driven, determine that the semipermeable membrane is in a state of allowing the gas to pass therethrough, and to stop driving the suction mechanism.

2. The liquid discharging apparatus according to claim 1, further comprising a second storage configured to store the liquid to be supplied to the first storage, wherein the first storage has a supply port through which the liquid is supplied from the second storage, and an opening and closing member configured to open and close the supply port is provided for the supply port.

3. The liquid discharging apparatus according to claim 2, wherein the opening and closing member is an opening and closing valve configured to open the supply port under a condition that the second storage is connected to the first storage and to close the supply port under a condition that the second storage is not connected to the first storage.

4. The liquid discharging apparatus according to claim 2, further comprising a third detector configured to detect whether the second storage is connected to the first storage.

5. The liquid discharging apparatus according to claim 1, wherein the controller is configured to determine that the liquid is discharged from the nozzle to the electrode under a condition that voltage of the electrode is lower than a predetermined threshold value, and the controller is configured to determine that the liquid is not discharged from the nozzle to the electrode under a condition that the voltage is equal to or higher than the predetermined threshold value.

6. The liquid discharging apparatus according to claim 5, wherein the controller is configured to:

determine whether the liquid is discharged from the nozzle toward the electrode by detecting the electrical change in the electrode by the second detector after a predetermined first time has elapsed from start of driving of the suction mechanism;

in a case of determining that the liquid is discharged from the nozzle toward the electrode, stop the driving of the suction mechanism, and in a case of determining that the liquid is not discharged from the nozzle toward the electrode, continue the driving of the suction mechanism.

7. The liquid discharging apparatus according to claim 6, wherein under a condition that the controller determines that the liquid is not discharged from the nozzle toward the electrode by the determination executed after the predetermined first time has elapsed from the start of driving of the suction mechanism, and that the second detector does not detect the electrical change in the electrode before a predetermined second time longer than the first time has elapsed, the controller is configured to determine whether the liquid is discharged from the nozzle toward the electrode by detecting the electrical change in the electrode by the second detector at the second time, under a condition that the controller determines that the liquid is discharged from the nozzle toward the electrode at the second time, the controller is configured to stop the driving of the suction mechanism, and under a condition that the controller determines that the liquid is not discharged from the nozzle toward the electrode at the second time, the controller is configured to continue the driving of the suction mechanism.

8. The liquid discharging apparatus according to claim 7, wherein the suction mechanism includes a pump configured to suck the gas and liquid in the cap, under a condition that the controller determines that the liquid is not discharged from the nozzle toward the electrode at the second time, the controller is configured to keep the cap in the predetermined posture with the lip in contact with the head unit during a certain period of time, and to drive the suction mechanism with the number of rotation of the pump being increased, and under the condition that the second detector detects the electrical change in the electrode in the certain period of time, the controller is configured to determine that the semipermeable membrane is in the state of allowing the gas to pass therethrough, and to stop the driving of the suction mechanism.

9. The liquid discharging apparatus according to claim 7, wherein the controller is configured to drive the suction mechanism preset N times, and under a condition that the second detector does not detect the electrical change in the electrode after driving the suction mechanism N times, the controller is configured to stop the driving of the suction mechanism and to execute an error process.

10. The liquid discharging apparatus according to claim 1, wherein the first storage is included in a plurality of first storages corresponding to a plurality of types of liquid, and the controller is configured to determine whether the semipermeable membrane is in the blocked state for each of the first storages.

11. The liquid discharging apparatus according to claim 1, wherein in a case of determining whether the semipermeable membrane is in the blocked state, the controller is configured to estimate a remaining amount of the liquid in the first storage, and under a condition that the estimated remaining amount of the liquid in the first storage is not equal to the amount of the liquid in the first storage detected by the first detector, the controller is configured to determine that the semipermeable membrane is in the blocked state.

12. A liquid discharging apparatus comprising:

a first storage having a supply port through which liquid is supplied from outside thereof and configured to store the liquid;

an opening and closing member configured to open and close the supply port;

a first detector configured to detect an amount of the liquid in the first storage;

a communication hole communicating the first storage and the outside;

a semipermeable membrane arranged to cover the communication hole, the semipermeable membrane being configured to prevent the liquid from passing therethrough and to allow gas to pass therethrough;

ahead unit having at least one nozzle configured to discharge the liquid supplied from the first storage;

a liquid flow channel configured to communicate the first storage and the head unit;

a cap configured to contact with the head unit to seal the nozzle, and configured to be separated from the head unit;

a second detector configured to detect that the liquid is discharged from the nozzle;

a suction mechanism configured to suck the liquid and gas inside the cap; and a controller, wherein the controller is configured to determine whether the amount of the liquid in the first storage changes over a predetermined amount, based on a change of detection signal from the first detector, and in a case of determining that the amount of the liquid in the first storage does not change over the predetermined amount, the controller is configured to:

drive the suction mechanism with the cap being in contact with the head unit; and under a condition that the second detector detects that the liquid is discharged from the nozzle in a state of the suction mechanism being driven, stop driving the suction mechanism.

13. The liquid discharging apparatus according to claim 12, further comprising a second storage configured to store the liquid to be supplied to the first storage, wherein the opening and closing member is configured to open the supply port under a condition that the second storage is connected to the first storage, and to close the supply port under a condition that the second storage is not connected to the first storage.

14. The liquid discharging apparatus according to claim 13, wherein the controller is configured to determine whether the second storage is connected to the first storage, and in a case of determining that the second storage is connected to the first storage, the controller is configured to determine whether the amount of the liquid in the first storage detected by the first detector changes over the predetermined range.

15. The liquid discharging apparatus according to claim 12, further comprising an electrode arranged in the cap and on which the liquid discharged from the nozzle is landed, wherein the second detector is electrically connected to the electrode and configured to detect that the liquid is discharged from the nozzle toward the electrode, and under a condition that the second detector detects an electrical change in the electrode caused by the liquid discharged from the nozzle toward the electrode in a state of the suction mechanism being driven, the controller is configured to determine that the semipermeable membrane is in a state of allowing the gas to pass therethrough, and to stop driving the suction mechanism.

16. The liquid discharging apparatus according to claim 15, wherein the controller is configured to:

determine whether the liquid is discharged from the nozzle toward the electrode by detecting the electrical change in the electrode by the second detector after a predetermined first time has elapsed from start of driving of the suction mechanism;

in a case of determining that the liquid is discharged from the nozzle toward the electrode, stop the driving of the suction mechanism, and in a case of determining that the liquid is not discharged from the nozzle toward the electrode, continue the driving of the suction mechanism.

17. The liquid discharging apparatus according to claim 16, wherein under a condition that the controller determines that the liquid is not discharged from the nozzle toward the electrode by the determination executed after the predetermined first time has elapsed from the start of driving of the suction mechanism, and that the second detector does not detect the electrical change in the electrode before a predetermined second time longer than the first time has elapsed, the controller is configured to determine whether the liquid is discharged from the nozzle toward the electrode by detecting the electrical change in the electrode by the second detector at the second time, under a condition that the controller determines that the liquid is discharged from the nozzle toward the electrode at the second time, the controller is configured to stop the driving of the suction mechanism, and under a condition that the controller determines that the liquid is not discharged from the nozzle toward the electrode at the second time, the controller is configured to continue the driving of the suction mechanism.

18. The liquid discharging apparatus according to claim 17, wherein the suction mechanism includes a pump configured to suck the liquid and the gas in the cap, under a condition that the controller determines that the liquid is not discharged from the nozzle toward the electrode at the second time, the controller is configured to keep the cap in contact with the head unit during a certain period of time, and to drive the suction mechanism with the number of rotation of the pump being increased, and under the condition that the second detector detects the electrical change in the electrode in the certain period of time, the controller is configured to determine that the semipermeable membrane is in the state of allowing the gas to pass therethrough, and to stop the driving of the suction mechanism.

19. The liquid discharging apparatus according to claim 17, wherein the controller is configured to drive the suction mechanism preset N times, and under a condition that the second detector does not detect the electrical change in the electrode after driving the suction mechanism N times, the controller is configured to stop the driving of the suction mechanism and to execute an error process.

20. The liquid discharging apparatus according to claim 12, wherein the first storage is included in a plurality of first storages corresponding to a plurality of types of liquid, and the controller is configured to determine whether the semipermeable membrane is in the blocked state for each of the first storages.

* * * * *